US006789532B2

(12) United States Patent
Kato et al.

(10) Patent No.: US 6,789,532 B2
(45) Date of Patent: Sep. 14, 2004

(54) MOUNTING DEVICE FOR EXHAUST GAS RECIRCULATION VALVE

(75) Inventors: Yasuhiko Kato, Tokyo (JP); Hisashi Yokoyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 71 days.

(21) Appl. No.: 10/311,975

(22) PCT Filed: Jul. 9, 2001

(86) PCT No.: PCT/JP01/05927

§ 371 (c)(1),
(2), (4) Date: Dec. 23, 2002

(87) PCT Pub. No.: WO03/006815

PCT Pub. Date: Jan. 23, 2003

(65) Prior Publication Data

US 2004/0099245 A1 May 27, 2004

(51) Int. Cl.[7] ..... F02M 25/07
(52) U.S. Cl. ..... 123/568.12
(58) Field of Search ..... 123/41.31, 568.11, 123/568.12, 568.18, 568.21

(56) References Cited

U.S. PATENT DOCUMENTS 5,690,082 A * 11/1997 Tanioka et al. ..... 123/568.12
5,970,960 A * 10/1999 Azuma ..... 123/568.12
6,237,547 B1 * 5/2001 Ishiyama ..... 123/568.12
6,513,507 B2 * 2/2003 Balekai et al. ..... 123/568.12
6,708,675 B2 * 3/2004 Kato et al. ..... 123/568.12

FOREIGN PATENT DOCUMENTS

| | | |
|---|---|---|
| JP | 53-109022 | 9/1978 |
| JP | 7-259657 | 10/1995 |
| JP | 8-218941 | 8/1996 |
| JP | 10-2256 | 1/1998 |
| JP | 11-311152 | 11/1999 |
| JP | 2000-87807 | 3/2000 |

* cited by examiner

*Primary Examiner*—Willis R. Wolfe, Jr.
(74) *Attorney, Agent, or Firm*—Sughrue Mion, PLLC

(57) ABSTRACT

The invention relates to a mounting device for mounting an exhaust gas recirculation valve connected to an exhaust gas reflux passage of an engine. A valve housing is mounted on a cooling water circulating part from an engine block, as well as the valve housing forms a part of a cooling water passage. Therefore, an intense heat of the exhaust gas can be absorbed in and radiated by the cooling water. In this manner, an abnormal over heat of a stepping motor due to the intense heat of the exhaust gas is prevented without forming any cooling water passage around the valve housing.

7 Claims, 6 Drawing Sheets

MOUNTING DEVICE FOR EXHAUST GAS RECIRCULATION VALVE

TECHNICAL FIELD

The present invention relates to a mounting device for mounting an exhaust gas recirculation valve located in a reflux passage of exhaust gas of an internal combustion engine and others.

BACKGROUND ART

FIG. 6 is a cross sectional view showing a conventional mounting device for mounting an exhaust gas recirculation valve. Referring to the drawing, a valve housing 1 includes an exhaust gas inlet 2 that communicates to an exhaust system (not shown) of an engine acting as an internal combustion engine, an outlet 3 that communicates to an air intake system (not shown) of the engine, and a passage 4 that is interposed between the outlet 3 and the mentioned inlet 2. In the passage 4, a valve seat 5 is press-fitted. Reference numeral 6 designates a valve rod that passes through a bush 7. A valve 8 that comes in contact with or separates from the valve seat 5 is mounted at a lower end portion of the valve rod 6. Numeral 9 designates a holder for preventing a deposit from entering the bush 7. Numeral 10 designates a spring holder that is given an upward impetus by coil spring (in other words, return spring) 11. A through-hole 12 is formed in a central portion of the spring holder 10. A tip portion 6*a* of the mentioned valve rod 6 is caulked and fixed into the through-hole 12. Due to this caulking, the valve 8, which is mounted at the lower end portion of the valve rode 6, is given an impetus at all times in the direction of closing the valve with respect to the valve seat 5. Furthermore, numeral 13 designates a cooling water passage for cooling a valve body and a motor, as described later. Numeral 15 designates a cap for sealing in an airtight manner.

Numeral 20 designates a stepping motor body serving as a stator assembly including a rotor portion described later. A spacer 21, which prevents water from entering the stepping motor body 20, is secured by a clamp screw 23 via a rubber ring 22 at a lower portion of the stepping motor body 20. A motor bush 25 for holding a motor shaft 24 is disposed in a central opening of the spacer 21. A spring holder 26 is connected to a lower end portion of the motor shaft 24. Numeral 28 designates a spring, that is, an assist spring that is disposed between the spacer 21 and the spring holder 26, and gives an impetus to the motor shaft 24 in the direction of opening the valve 8.

Numeral 30 designates a bobbin around which a coil 31 is wound, and a yoke 32 and a yoke 33 providing a magnetic passage are formed about an outer periphery of the bobbin 30. Numeral 34 designates a terminal, which is electrically connected to the coil 31 and forms a connector section along with a motor housing 35. Numeral 36 designates a plate for shielding two coil parts in terms of magnetism. Numeral 37 designates a plate for preventing resin from coming into an inner periphery of the coil part at the time when the motor housing 35 is molded exteriorly.

Numeral 40 designates a magnet. Numeral 41 designates a rotor, which holds the magnet 40, and at an inner periphery portion of which a female-threaded part 41*a* engaging with a male-threaded part 24*a* of the motor shaft 24, and a stopper 41*b* in an axial direction for the motor shaft 24 are formed. Numeral 42 designates a bearing mounted on both ends of the rotor 41. Numeral 24*b* designates a stopper part provided at the motor shaft 24.

The stepping motor body 20 as constructed above is mounted onto the mentioned valve housing so as to be coaxial by means of a fixing screw 44.

In addition, relation between the rotor 41 and the motor shaft 24 is now described. A lower half of the motor shaft is a plate-like member 24*c*, which includes a shaft in the direction of the motor shaft 24 at the center part thereof. The plate-like member 24*c* is inserted through a substantially square through hole of the motor bush 25 to be prevented from rotation. Further, the plate-like member 24*c* is held so as to be capable of moving in an axial direction thereby enabling the motor shaft 24 to move in up and down direction. By the screw-engagement between the male-threaded part 41*a* of the rotor 41 and the female-threaded part 24*a* of the motor shaft 24, the rotation of the rotor 41 causes the motor shaft 24 to move up and down. The axial stopper 41*b* is a protrusion provided in a recess at an inner periphery of the rotor 41. The axial stopper 41*b* comes into contact with the plate-like member 24*c* of the axial stopper 41*b* at an upper dead point of the motor shaft 24 due to the rotation of the rotor 41. The rotor 41 is prevented from further rotation in one direction beyond the upper dead point, thereby the rise of the motor shaft 24 being stopped. At this time, the rotor 41 can rotate in the other direction, and therefore the axial stopper 41*b* does not come in contact with the plate-like member 24*c* any more when the motor shaft 24 comes down by the rotation of the rotor 41 in the other direction. In this manner, the rotor can continue to rotate in the other direction, and the motor shaft can come down further.

Now operation is described. First, for starting from the state of the valve being fully closed, the coil 31 of the stepping motor 20 is energized in response to a pulsed voltage transmitted to the terminal 34 from a control unit (not shown) at the time of opening operation of the valve. Then the rotor 41 including the magnet 40 rotates stepwise in the direction of opening the valve. At this time, number of transmission pulses is coincident with that of steps, thereby enabling an accurate open-loop control. This stepwise rotation is converted into a liner movement by and with the female-threaded part 41*a* of the rotor 41 and the male-threaded part 24*a* of the motor shaft 24, and the motor shaft 24 moves in the direction of opening the valve (downward). At this time, the motor shaft 24 is assisted by the force of the assist spring 28 in the movement thereof. When the movement goes on and a top end surface of a tip portion 6*a* of the valve rod 6 comes in contact with a lower end surface of the motor shaft 24, the valve rod 6 comes down against an upward impetus exerted by the return spring 11 due to a drive force of the motor shaft 24. Furthermore, the valve 8, which is mounted on the lower end portion of the valve rod 6, also comes down with respect to the valve seat 5 to open the valve. Thus, the inlet 2 and the outlet 3 of the exhaust gas communicate with each other via the passage 4.

At the time of closing the valve, the operation reverse to the mentioned one is carried out. The rotor, which includes the magnet 40, rotates stepwise in the direction of closing the valve in response to a pulsed voltage transmitted from the control unit (not shown) to the terminal 34. This rotation causes the motor shaft 24 to move in the direction of closing the valve (upward). Following this movement, also the valve rod 6 rises by an upward impetus exerted by the coil spring 11, and then the valve 8 closes the opening of the valve seat 5.

The conventional mounting device for mounting the exhaust gas recirculation valve is constructed as described above, and therefore the stepping motor body and the valve body can be cooled with the cooling water introduced into the cooling water passage 13. However, since the cooling water passage 13 is formed around the valve housing 1, the valve body becomes large in size. Moreover, e.g., a piping for connecting the cooling water passage 13 to that of the engine system is required, which means that a water-cooling piping only for mounting the exhaust gas recirculation valve of complicated construction composed of a large number of parts is required. Hence, a problem exits in that the structure as described above brings about an increase in cost.

The present invention was made to solve the problems described above, and has an object of achieving a mounting device for mounting an exhaust gas recirculation valve capable of preventing a stepping motor, which drives and controls the exhaust gas recirculation valve, and a valve body from being over-heated due to an intense heat of the exhaust gas, and capable of reducing cost without requiring any cooling water piping for mounting the exhaust gas recirculation valve.

DISCLOSURE OF INVENTION

A mounting device for mounting an exhaust gas recirculation valve comprises: a valve housing that is connected and located in an exhaust gas reflux passage of an engine; a valve seat that is provided in an internal part of the mentioned valve housing; a valve rod that is mounted in an axially movable manner on the mentioned valve housing; a valve that is connected to the mentioned valve rod to be accommodated in the mentioned valve housing, and that moves in a direction of coming close to and in contact with the mentioned valve seat when the mentioned valve rod moves in one direction, as well as moves in a direction of being separate from the mentioned valve seat when the mentioned valve rod moves in the other direction; and a stepping motor that drives and controls the mentioned valve in a direction of opening or closing the valve via the mentioned valve rod;

the mentioned mounting device for mounting an exhaust gas recirculation valve being characterized in that a portion for mounting the mentioned valve housing on a cooling water circulating part for circulating cooling water from an engine block is provided in the mentioned valve housing, as well as the mentioned cooling water circulating part is constructed so that a part of a cooling water passage may be open at a portion of the mentioned valve housing being mounted thereon; and the mentioned valve housing is mounted on the mentioned cooling water circulating part, whereby the mentioned valve housing and the mentioned cooling water circulating part form the cooling water passage.

In the mounting device for mounting an exhaust gas recirculation valve of above construction, an intense heat of the exhaust gas can be absorbed in and radiated by circulating the cooling water taken out of the engine block or flowing into the engine block while bringing the cooling water into contact with the valve housing. As a result, the stepping motor driving and controlling the exhaust gas recirculation valve, and the valve body can be prevented from being overheated due to the intense heat of the exhaust gas without forming any additional cooling water passage around the valve housing of the exhaust gas recirculation valve. In this manner, reduction in cost can be achieved.

In the mentioned mounting device for mounting an exhaust gas recirculation valve according to the invention, it is preferable that a recess is provided in the area where the cooling water is in contact and circulates at a portion of mounting the mentioned valve housing on the mentioned cooling water circulating part; and that a protrusion is formed on the side opposite to the recess of the mentioned cooling water passage so that the cooling water is easy to flow into the recess side.

In the mounting device for mounting an exhaust gas recirculation valve of above construction, the cooling water passage is in the sate of getting into the valve housing of the exhaust gas recirculation valve. Accordingly, a surface area of the cooling water being in contact with the valve housing increases, thereby making it possible to enhance a cooling effect for the valve housing.

In the mentioned mounting device for mounting an exhaust gas circulation valve according to the invention, it is preferable that the portion where the cooling water is in contact and circulates is configured so as to have a smoothly curved surface along with a wall surface of the cooling water passage of the mentioned cooling water circulating part at the portion of mounting the cooling water circulating part of the valve housing.

In the mounting device for mounting an exhaust gas recirculation valve of above construction, resistance that occurs on the wall surface can be reduced during circulation of the cooling water, and residence area of the cooling water decreases. Therefore, not only the cooling effect for the valve housing can be enhanced but also a small strength of force is sufficient to circulate the cooling water. As a result, load on the cooling water pump can be reduced, making it possible to downsize the cooling water pump.

In the mentioned mounting device for mounting the exhaust gas recirculation valve according to the invention, it is preferable that a protrusion is provided in the area where the cooling water is in contact and circulates at a portion of mounting the mentioned valve housing on the mentioned cooling water circulating part.

In the mounting device for mounting the exhaust gas recirculation valve of above construction, a surface area of the cooling water being contact with the valve housing increases, making it possible to enhance the cooling effect for the valve housing.

BEST MODE FOR CARRYING OUT THE INVENTION

To describe in detail the present invention, best modes for carrying out the present invention are hereinafter described with reference to the accompanying drawings.

Embodiment 1.

Figure 1:
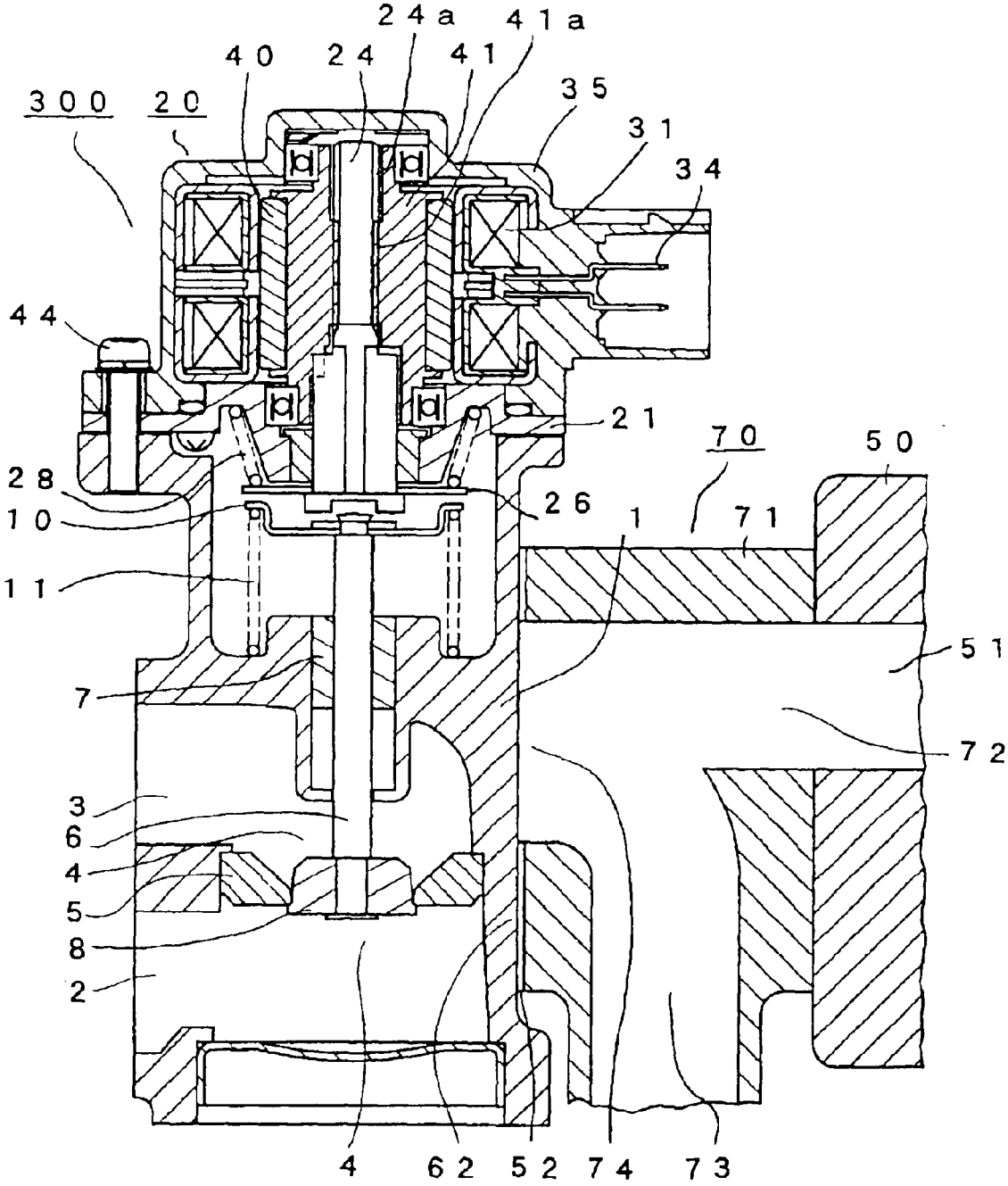
FIG. 1 is a cross sectional view showing a mounting device for mounting an exhaust gas recirculation valve according to a first preferred embodiment of the present invention.

FIG. 1 is a cross sectional view showing a mounting device for mounting an exhaust gas recirculation valve according to a first preferred embodiment of the invention. In the drawing, reference numeral 50 designates an engine block part. Numeral 51 designates a cooling water passage that is provided in the engine block 50, and cools an engine system. This cooling water passage 51 is the one that the engine block 50 of a water-cooling engine essentially includes. Numeral 70 designates a cooling water circulating part such as a water outlet, which is mounted on the engine block 50. Numeral 71 designates a body of the cooling water circulating part. Numeral 72 designates a cooling water inlet side passage. Numeral 73 designates a cooling water outlet side passage. Numeral 74 designates a passage opening.

Numeral 300 designates an exhaust gas recirculation valve to be mounted on the cooling water circulating part 70. Numeral 1 designates a valve housing of the exhaust gas recirculation valve. Numeral 62 designates a portion of mounting the valve housing 1 on the mentioned cooling water circulating part 70. Numeral 52 designates a gasket that is interposed between the mentioned mounting portion 62 and the mentioned cooling water circulating part 70, causing the cooling water passage to be airtight. Numeral 2 designates an exhaust gas inlet of the valve housing 1. Numeral 3 designates an exhaust gas outlet of the valve housing 1. Numeral 5 designates a valve seat press-fitted and held in the mentioned exhaust gas outlet 3. Numeral 6 designates a valve rod mounted on the valve housing 1 so as to be capable of moving axially. Numeral 8 designates a valve connected to a lower end portion of the valve rod 6. Numeral 7 designates a bearing for the valve rod 6. Numeral 10 designates a spring swivel plate mounted on an upper end of the mentioned valve rod 6. Numeral 11 designates a return spring giving an impetus in a direction of closing the valve 8 to the valve rod 6 via the mentioned spring swivel plate 10.

Numeral 20 designates a stepping motor that drives and controls the valve 8 in a direction of opening and closing the valve 8 via the valve rod 6. Numeral 35 designates a motor housing for the mentioned stepping motor 20. This motor housing 35 is clamped and secured onto an upper end of the valve housing 1 by means of a clamp screw 44 via a spacer 21. Numeral 31 designates a coil of the stepping motor. Numeral 34 a terminal electrically connected to the coil 31. Numeral 41 designates a rotor of the stepping motor 20. Numeral 24 designates a motor shaft of the stepping motor 20, and the rotor 41 and the motor shaft 24 are screw-engaged with each other.

Numeral 26 designates a spring holder connected to a lower end portion of the motor shaft 24. Numeral 28 designates an assist spring interposed between the spring holder 26 and the spacer 21. This assist spring 28 gives an impetus to the motor shaft 24 in the direction of opening the valve, assisting a motor drive force.

Figure 6:
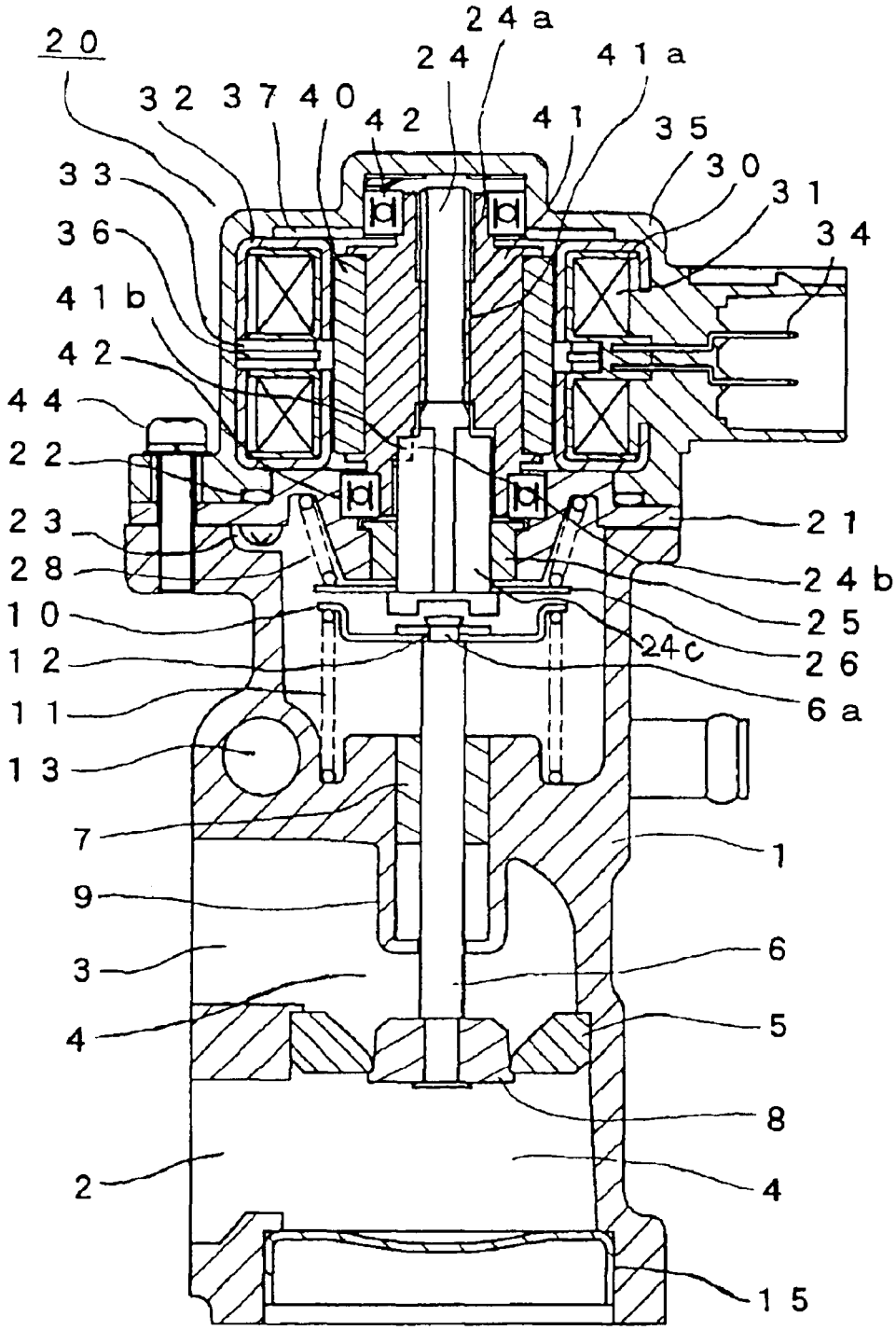
Fig. 6 (PRIOR ART)
FIG. 6 is a cross sectional view showing a mounting device for mounting an exhaust gas recirculation valve according to the prior art.

In addition, construction and operation of the stepping motor 20 are arranged in the same manner as in the prior art shown in FIG. 6 and therefore a further description will be omitted.

Now, operation is hereinafter described. In the case of starting from the sate of the valve being fully closed, the coil 31 of the stepping motor 20 is energized in response to a pulsed voltage transmitted from the control unit (not shown) to the terminal 34 at the time of opening operation of the valve. Then the rotor 41 including the magnet 40 rotates stepwise in the direction of opening the valve. At this time, number of transmission pulses is coincident with number of steps thereby enabling an accurate open-loop control. This stepwise rotation is converted into a liner movement by and with the female-threaded part 41*a* of the rotor 41 and the male-threaded part 24*a* of the motor shaft 24, and the motor shaft 24 moves in the direction of opening the valve (downward, in the drawing). At this time, the motor shaft 24 is assisted with a force of the assist spring in the movement thereof. When the movement goes on and a lower end of the motor shaft 24 comes in contact with an upper end of the valve rod 6, the valve rod 6 comes down against an upward impetus exerted by the return spring 11 due to the drive force of the motor shaft 24. Further, the valve 8 mounted on the lower end portion of the valve rod 6 comes down with respect to the valve seat 5 to open the valve, resulting in the communication between the exhaust gas inlet 2 and outlet 3 via the gas passage 4. When opening the valve 8 in this manner, the exhaust gas flowing in an exhaust gas reflux passage from the combustion chamber of the engine flows through: the exhaust gas inlet 2 of the valve housing 1 → the passage 4 in the valve housing 1 → the exhaust gas outlet 3 in the valve housing 1.

On the other hand, an engine cooling water flows through: the cooling water passage 51 of the engine block 50 → the cooling water inlet side passage 72 of the cooling water circulating part 71 → the opening 74 of the passage → the cooling water outlet side passage 73. An intense heat of the mentioned exhaust gas (usually 300 to 400° C.) is absorbed in and radiated by the cooling water. Therefore, the intense heat of the exhaust gas is not transferred from the valve housing 1 to the stepping motor 20. Thus, the stepping motor 20 can be prevented from abnormal over heating due to the intense heat of the exhaust gas.

In the first embodiment constructed as described above, the engine cooling water (usually not boiling even after having cooled the engine), of which temperature is lower than the exhaust gas temperature (usually 300 to 400° C.), circulates while being in contact with the valve housing 1. Further, the stepping motor 20 is mounted on the top portion of the valve housing 1. Therefore, the intense heat of the exhaust gas can be absorbed in and radiated by the cooling water. An advantage is achieved in that the stepping motor 20 can be prevented from the overheat due to the intense heat of the exhaust gas without forming any cooling water passage around the valve housing 1. Further, such prevention from overheat is achieved without requiring any dedicated piping only for connecting the cooling water passage to that of the engine system.

In addition, in the above description, the valve housing is cooled by the cooling water, which has been already used for cooling the engine. It is, however, also preferable that the cooling water, which has been already used for cooling the valve housing, cools the engine.

Furthermore, supposing that the cooling water circulating part such as a water outlet and the exhaust gas recirculation valve are delivered to an automaker in the state of being assembled in advance, an advantage is achieved in that number of processes for mounting the parts on the engine can be reduced on the part of the automaker.

Embodiment 2.

Figure 2:
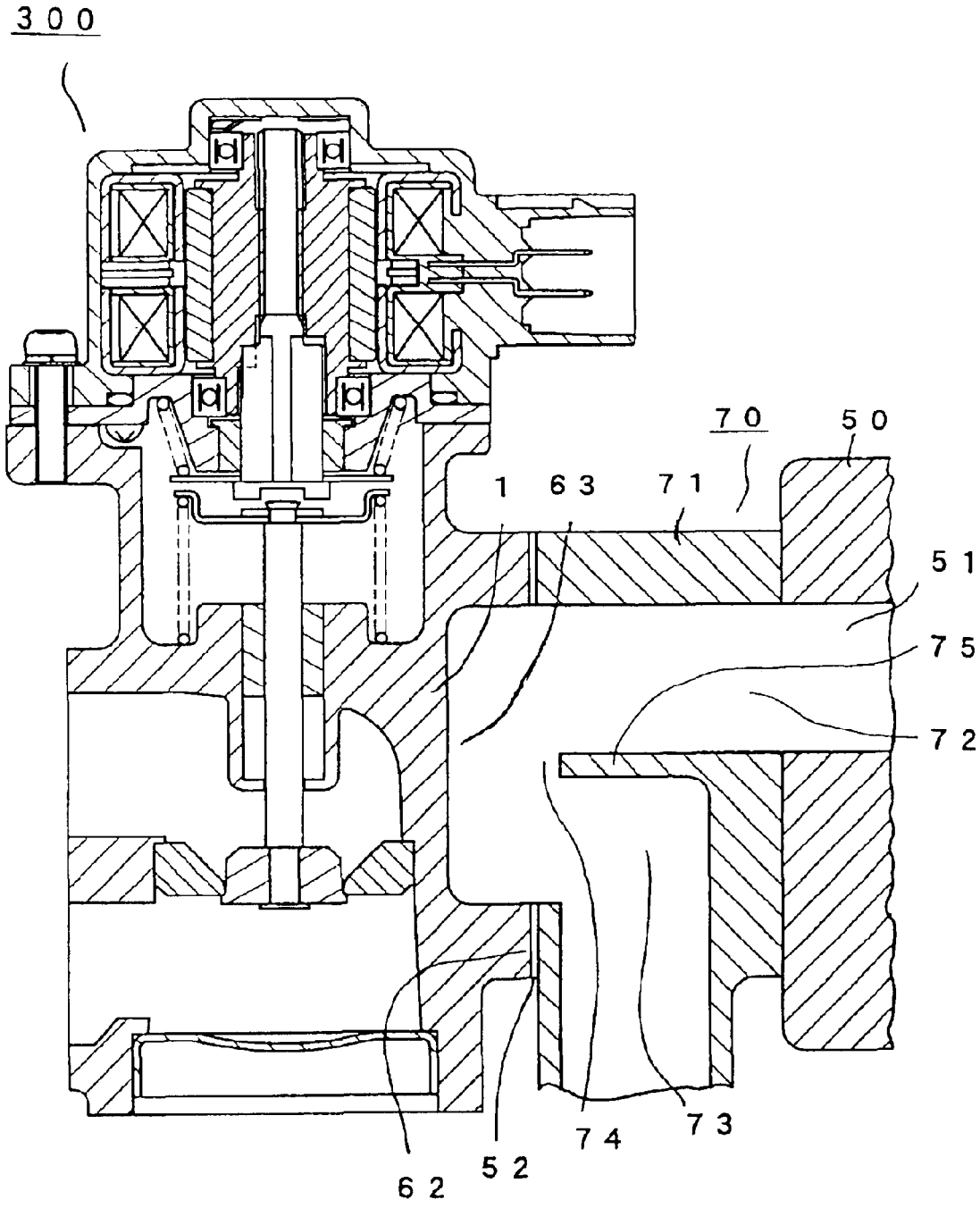
FIG. 2 is a cross sectional view showing a mounting device for mounting an exhaust gas recirculation valve according to a second preferred embodiment of the invention.

FIG. 2 is a cross sectional view showing a mounting device for mounting an exhaust gas recirculation valve according to a second preferred embodiment of the invention. In the drawing, numeral 63 designates a recess provided in the valve housing. Numeral 75 designates a wall separating the cooling water inlet side passage 72 of the cooling water circulating part 70 from the cooling water outlet side passage 73 thereof. As described above, in the valve housing 1, the recess 63 is provided in the area where the cooling water is in contact and circulates at the portion of mounting the valve housing 1 on the cooling water circulating part 70. Further, to enhance the likelihood of the cooling water flowing into the recess 63 side of the valve housing 1 and increase a cooling effect, a wall, that is, a protrusion 75 is formed on the side opposite to the recess in the cooling water passage.

In this second embodiment, the passage of the cooling water is constructed in the sate of getting into the valve housing 1 of the exhaust gas recirculation valve 300. Accordingly, a surface area of the cooling water being in contact with the valve housing 1 increases, making it possible to enhance the cooling effect for the valve housing 1.

Embodiment 3.

Figure 3:
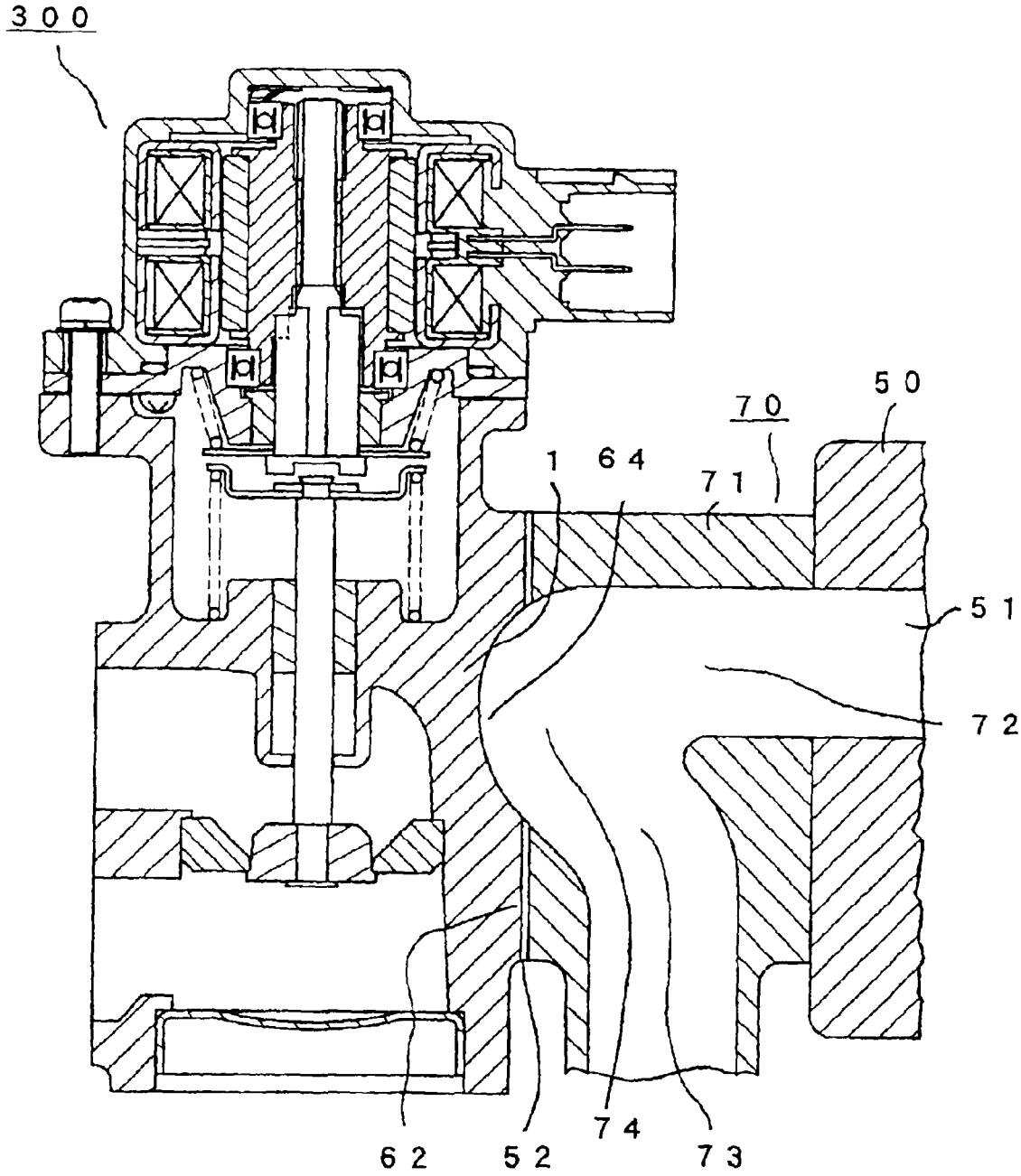
FIG. 3 is a cross sectional view showing a mounting device for mounting an exhaust gas recirculation valve according to a third preferred embodiment of the invention.

FIG. 3 is a cross sectional view showing a mounting device an exhaust gas recirculation valve according to a third preferred embodiment of the invention. In the drawing, numeral 64 designates a recess provided in the valve housing 1, and the recess 64 is configured so as to have a smoothly curved surface along with a wall surface of the cooling water passage of the cooling water circulating part 70.

That is, in this third embodiment, the cooling water passage is configured so as to have a smoothly curved surface between the cooling water inlet side passage 72, the recess 64 in the valve housing 1, and the cooling water outlet side passage 73. In other words, the area where the cooling water is in contact and circulates is formed into a configuration so as to have a smoothly curved surface along with the wall surface of the cooling water passage in the mentioned cooling water circulating part 70 at the portion of mounting the mentioned valve housing 1 on the mentioned cooling water circulating part 70.

Thus, in this third embodiment, resistance that occurs on the wall surface can be reduced during circulation of the cooling water. Further, because there is no residence region of the cooling water, not only the cooling effect for the valve housing 1 can be enhanced but also a small force is enough to circulate the cooling water. As a result, load on the cooling water pump can be reduced thereby making it possible to downsize the cooling water pump or prolong the lifetime thereof.

Embodiment 4.

Figure 4:
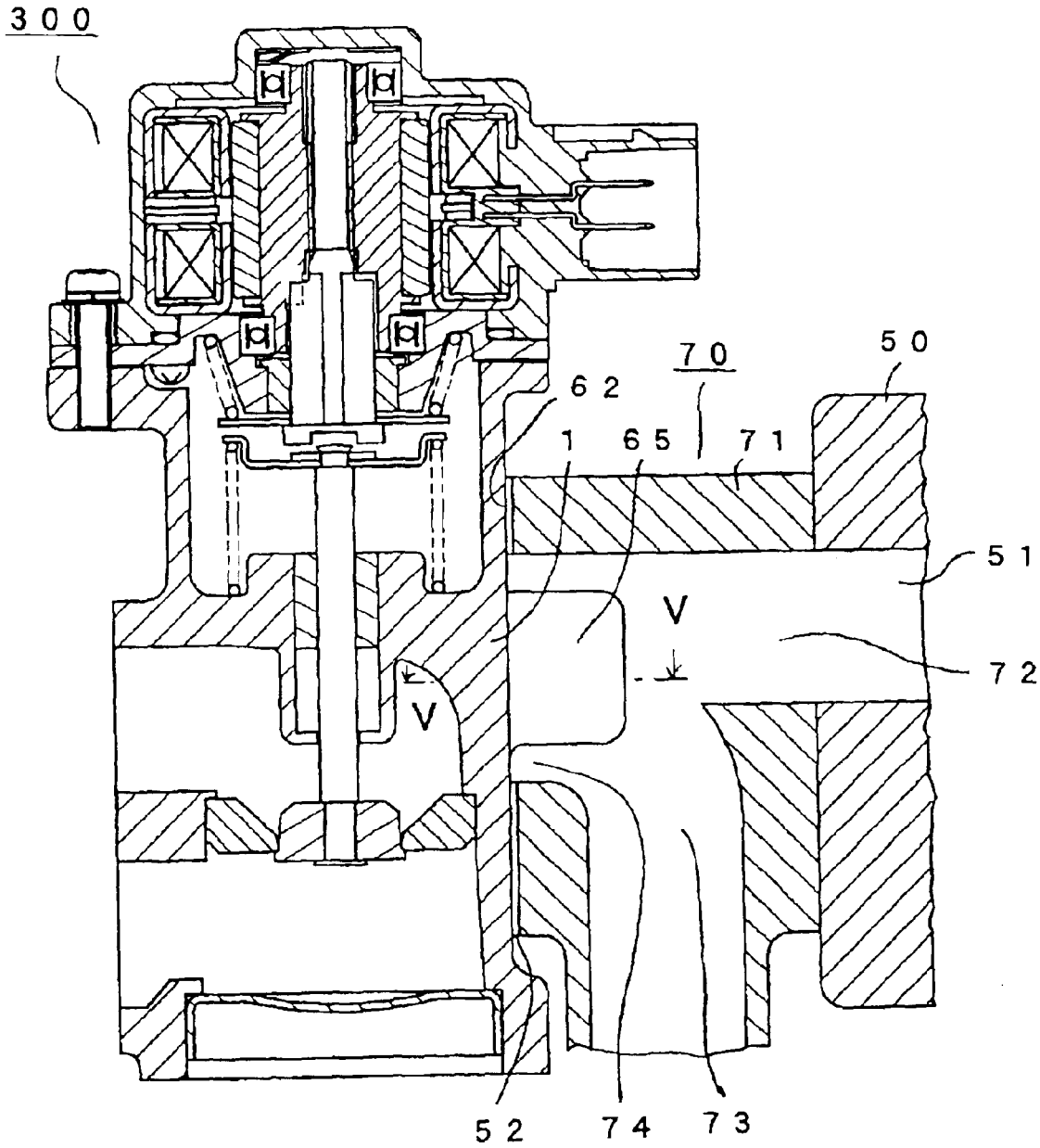
FIG. 4 is a cross sectional view showing a mounting device for mounting an exhaust gas recirculation valve according to a fourth preferred embodiment of the invention.
Figure 5:
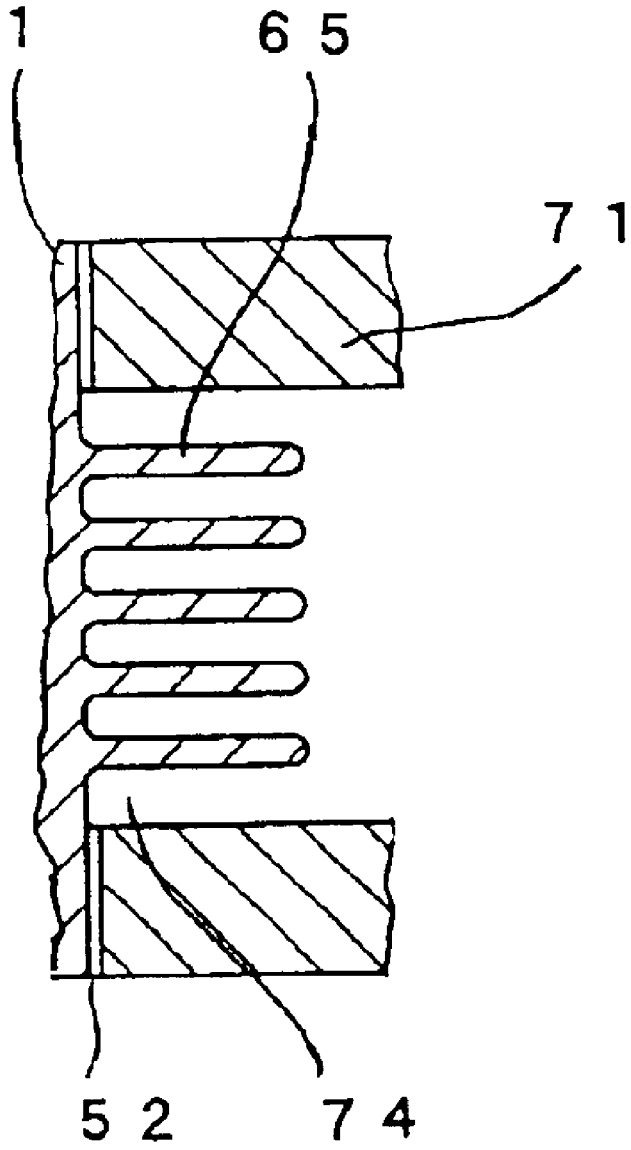
FIG. 5 is a cross sectional view taken along the line V—V of FIG. 4.

FIG. 4 is a cross sectional view showing a mounting device for mounting an exhaust gas recirculation valve according to a fourth preferred embodiment of the invention. FIG. 5 is a cross sectional view taken along the line V—V of FIG. 4. In the drawing, numeral 65 designates a protrusion, which is provided in the area where the cooling water is in contact and circulates at the portion of mounting the valve housing 1 on the cooling water circulating part 70. That is, this protrusion is in the state of extending into the cooling water passage from the passage opening 74 of the cooling water circulating part 70.

Thus, in this fourth embodiment, a surface area of the valve housing 1 being in contact with the cooling water is increased or enlarged by forming the protrusion 65 so as to extend into the cooling water passage, thereby making it possible to enhance the cooling effect for the valve housing 1.

In addition, it is preferable that the protrusion 65 is provided on the surface portion of the recess 63 in the valve housing 1 of FIG. 2 so as to extend into the cooling water passage. It is also preferable that the protrusion 65 is provided on the surface portion of the recess 64 of FIG. 3 so as to extend into the cooling water passage. The cooling effect is enhanced further in either case.

INDUSTRIAL APPLICABILITY

As described above, in the mounting device for mounting an exhaust gas recirculation valve according to this invention, a valve housing is mounted on a cooling water circulating part from an engine block such as a water outlet, and the valve housing forms a part of a cooling water passage. Thus, during the cooling water taken out of, e.g., the engine block circulates within the cooling water circulating part, the cooling water is to circulate while being directly in contact with the valve housing thereby enabling the cooling water to absorb and radiate an intense heat of the exhaust gas. In this manner, the overheat of the stepping motor due to the intense heat of the exhaust gas can be prevented without forming any cooling water passage around the valve housing of the exhaust gas recirculation valve.

What is claimed is:

1. A mounting device for mounting an exhaust gas recirculation valve comprises: a valve housing that is connected and located in an exhaust gas reflux passage of an engine; a valve seat that is provided in an internal part of said valve housing; a valve rod that is mounted in an axially movable manner on said valve housing; a valve that is connected to said valve rod to be accommodated in said valve housing, and that moves in a direction of coming close to and in contact with said valve seat when said valve road moves in one direction, as well as moves in a direction of being separate from said valve seat when said valve rod moves in the other direction; and a stepping motor that drives and controls said valve in a direction of opening or closing the valve via said valve rod;

said mounting device for mounting an exhaust gas recirculation valve being characterized in that a portion for mounting said valve housing on a cooling water circulating part for circulating cooling water from an engine block is provided in said valve housing, as well as said cooling water circulating part is constructed so that a part of a cooling water passage may be open at a portion of said valve housing being mounted thereon; and said valve housing is mounted on said cooling water circulating part, whereby said valve housing and said cooling water circulating part form the cooling water passage.

2. The mounting device for mounting an exhaust gas recirculation valve according to claim 1, characterized in that a recess is provided in the area where the cooling water is in contact and circulates at a portion of mounting said valve housing on said cooling water circulating part; and that a protrusion is formed on the side opposite to the recess of said cooling water passage so that the cooling water is easy to flow into said recess side.

3. The mounting device for mounting an exhaust gas recirculation valve according to claim 1, characterized in that the portion where the cooling water is in contact and circulates is configured so as to have a smoothly curved surface along with a wall surface of the cooling water passage of said cooling water circulating part at the portion of mounting said cooling water circulating part of said valve housing.

4. The mounting device for mounting an exhaust gas recirculation valve according to claim 2, characterized in that the portion where the cooling water is in contact and circulates is configured so as to have a smoothly curved surface along with a wall surface of the cooling water passage of said cooling water circulating part at the portion of mounting said cooling water circulating part of said valve housing.

5. The mounting device for mounting an exhaust gas recirculation valve according to claim 1, characterized in that a protrusion is provided in the area where the cooling water is in contact and circulates at a portion of mounting said valve housing on said cooling water circulating part.

6. The mounting device for mounting an exhaust gas recirculation valve according to claim 2, characterized in that a protrusion is provided in the area where the cooling water is in contact and circulates at a portion of mounting said valve housing on said cooling water circulating part.

7. The mounting device for mounting an exhaust gas recirculation valve according to claim 3, characterized in that a protrusion is provided in the area where the cooling water is in contact and circulates at a portion of mounting said valve housing on said cooling water circulating part.

* * * * *